United States Patent [19]

Ennis

[11] Patent Number: 4,921,056

[45] Date of Patent: May 1, 1990

[54] HAMMER DRILLS FOR MAKING BOREHOLES

[76] Inventor: Melvyn S. J. Ennis, 19 Wynnland Park, Carnmoney, Newtownabbey, County Antrim, Northern Ireland, BT36 6SE

[21] Appl. No.: 178,688

[22] Filed: Apr. 6, 1988

[30] Foreign Application Priority Data

Apr. 23, 1987 [GB] United Kingdom ..... 8709572
Jan. 29, 1988 [GB] United Kingdom ..... 8801969

[51] Int. Cl.[5] ..... E21B 4/14

[52] U.S. Cl. ..... 175/92; 173/78; 173/80; 173/136; 173/138; 175/296

[58] Field of Search ..... 175/92, 296; 173/78, 173/80, 73, 72, 136, 138, 135, 134

[56] References Cited

U.S. PATENT DOCUMENTS

| | | | |
|---|---|---|---|
| 2,887,989 | 5/1959 | Dulaney | 175/92 X |
| 3,105,559 | 10/1963 | Collier et al. | 173/78 X |
| 3,187,823 | 6/1965 | Cleary | 175/92 X |
| 3,453,657 | 7/1969 | Bolton et al. | 173/136 X |
| 3,583,501 | 6/1971 | Aalund | 173/78 X |
| 3,692,122 | 9/1972 | Currington | 175/296 X |
| 3,795,283 | 3/1974 | Oughton | 175/92 X |
| 3,941,196 | 3/1976 | Curington et al. | 173/78 X |
| 4,321,974 | 3/1982 | Klemm | 175/92 |
| 4,402,370 | 9/1983 | Gein et al. | 173/135 X |
| 4,446,929 | 5/1984 | Pillow | 173/80 X |
| 4,509,606 | 4/1985 | Willis | 175/69 |
| 4,705,118 | 11/1987 | Ennis | 175/92 X |
| 4,771,835 | 9/1988 | Eaton | 175/92 |

FOREIGN PATENT DOCUMENTS

| | | | |
|---|---|---|---|
| WO87/01413 | 3/1987 | PCT Int'l Appl. | 173/134 |
| 2179381 | 3/1987 | United Kingdom | 173/135 |

*Primary Examiner*—Hoang C. Dang
*Attorney, Agent, or Firm*—Nixon & Vanderhye

[57] ABSTRACT

A valveless-type down-the-hole hammer drill which has an inner tube extending from the upper end of the hammer body into a central opening in a cutter bit reciprocably mounted in a chuck on the opposite end of the hammer body. High pressure fluid is supplied to the interior of the inner tube and a piston surrounding the inner tube has internal surfaces controlling connection of a port to chambers above and below the piston. The external surface of the piston controls connection of these chambers to an exhaust port. A valve sleeve on the chuck coacts with the piston in this respect.

15 Claims, 2 Drawing Sheets

HAMMER DRILLS FOR MAKING BOREHOLES

Figure 1:
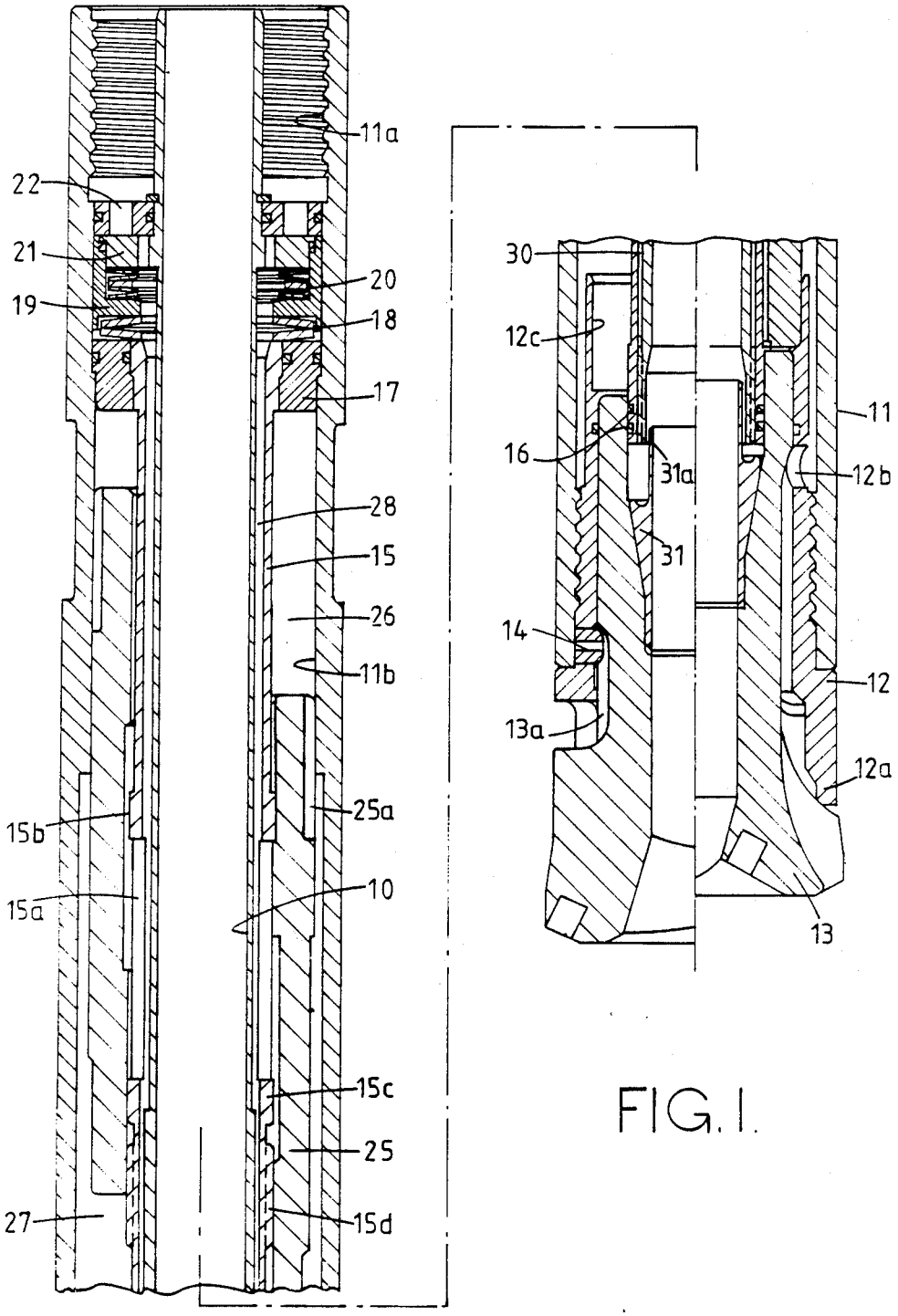

This invention relates to hammer drills for making boreholes.

It is already known to employ hammer drills of the so-called "down-the-hole" type for drilling boreholes. Such hammer drills employ a hammer mechanism built into a drill head and driven by a pressurised fluid supply to apply repeated percussive blows to a drill bit carried by the drill head.

There are two basic types of hammer mechanisms, namely valveless mechanisms and valved mechanisms. In the latter type, a pressure operated valve directs the flow of pressurised fluid to act on one end of a hammer piston or the other. In the valveless type, the hammer piston itself acts as a valve, such that various fluid flow passages are opened or closed in accordance with the position of the piston. The present invention is concerned with hammer drills of the valveless type.

Many different designs of valveless hammer mechanisms are already known, but the existing designs make use of very complex piston designs in which there are complicated port and/or passage configurations formed in the hammer piston itself. Since the hammer piston is subjected in use to very high loads, these complex configurations can result in damage to the piston.

It is an object of the invention to provide a valveless type hammer drill in which this disadvantage is avoided.

In accordance with the invention there is provided a valveless-type hammer drill comprising a body tube adapted at one end for attachment to a tubular drill string, a chuck mounted on the opposite end of said body tube, a cutter bit retained by said chuck and movable axially relative thereto, an inner tube extending coaxially within the body tube and slidably engaged in a bore in the cutter bit, an annular section piston slidably mounted on the inner tube, the piston coacting with ports formed in the wall of the inner tube in controlling the supply of high pressure fluid from said inner tube to chambers between the inner tube and the body tube and disposed respectively at opposite ends of the body tube, an exhaust port formed in the chuck and valve surfaces on the exterior of the piston coacting with the wall of the body tube and with a valve sleeve on the chuck in controlling communication of said chambers with said exhaust port, whereby, in use, the piston is reciprocated in the body and repeatedly delivers percussive blows to the cutter bit.

The provision of an inner tube extending completely through the piston and providing the high pressure porting for the hammer mechanism enables the piston shape to be kept very simple indeed. The interior of the piston may be of simple stepped cylindrical shape. Similarly the exterior shape can also be kept extremely simple.

Not only does this simplicity of piston shape avoid the stress concentrations which ultimately gave rise to the piston damage in the known complex shape pistons, but it also enables the maximum piston cross-sectional area to be employed in a body tube of given size. This feature is of particular importance when the invention is applied to a sampling hammer drill, having a sample tube inside the inner tube. This invention is, however, also applicable to hammer drills without any sample tube, in which the exhausted fluid escapes up through the borehole.

In conventional hammer drills communication between an exhaust port and a chamber in the body at the cutter bit side of the piston is controlled by a valving element mounted on the cutter bit (or an anvil which transmits percussive blows to the cutter bit). The valving element is usually a tube the interior of which is effectively an exhaust port through which hammer exhausts exits into the borehole via passageways in the cutter bit.

This conventional arrangement has many disadvantages. Firstly, the centrally positioned tubular valve element is likely to be damaged as a result of any slight misalignment between the piston and the bit which may develop when the bit starts to wear. Such damage will rapidly reduce the efficiency of the hammer. The valve element is frequently formed of nylon, which has a tendency to absorb oil and swell so that it seizes or becomes detached. Furthermore, the known construction cannot be applied to sampling-type hammer drills in which a central tube is used to return chippings etc. cut by the hammer to the ground surface via a second tube within the drill string.

It is thus another object of the present invention to provide a valveless-type hammer drill in which these and other disadvantages are avoided.

Accordingly the invention also provides a valveless-type hammer drill comprising a body tube adapted at one end for attachment to a drill string via which a supply of high pressure fluid is connected in use to the hammer drill, a chuck mounted on the opposite end of said body, a cutter bit retained by said chuck for axial movement relative thereto, a piston within said body reciprocable axially therein into percussive contact with the cutter bit, supply control means co-operating with the piston and selectively connecting chambers within the body tube at opposite sides of said piston to said supply according to the axial position of the piston, and exhaust control means co-operating with said piston and selectively connecting said chambers to an exhaust port in accordance with the axial position of the piston, said exhaust control means including a sleeve on the chuck projecting towards said one end of the body tube, an annular space surrounding said sleeve communicating with said exhaust port and the sleeve being arranged to receive one axial end of the piston and cut the associated chamber off from the exhaust port when the piston is approaching the cutter bit.

The invention also resides in a valveless-type hammer drill in which a hammer piston reciprocable by fluid pressure is percussively contactable with a cutter bit, said piston coacting with a foot valve element whereby communication between an exhaust port and a chamber on one side of said piston is interrupted as the piston approaches the cutter bit, characterised by the fact that said foot valve element comprises a sleeve formed on a chuck which retains said cutter bit, the interior of the sleeve receiving the end of the piston as it approaches the cutter bit.

In the accompanying drawings

Figure 2:
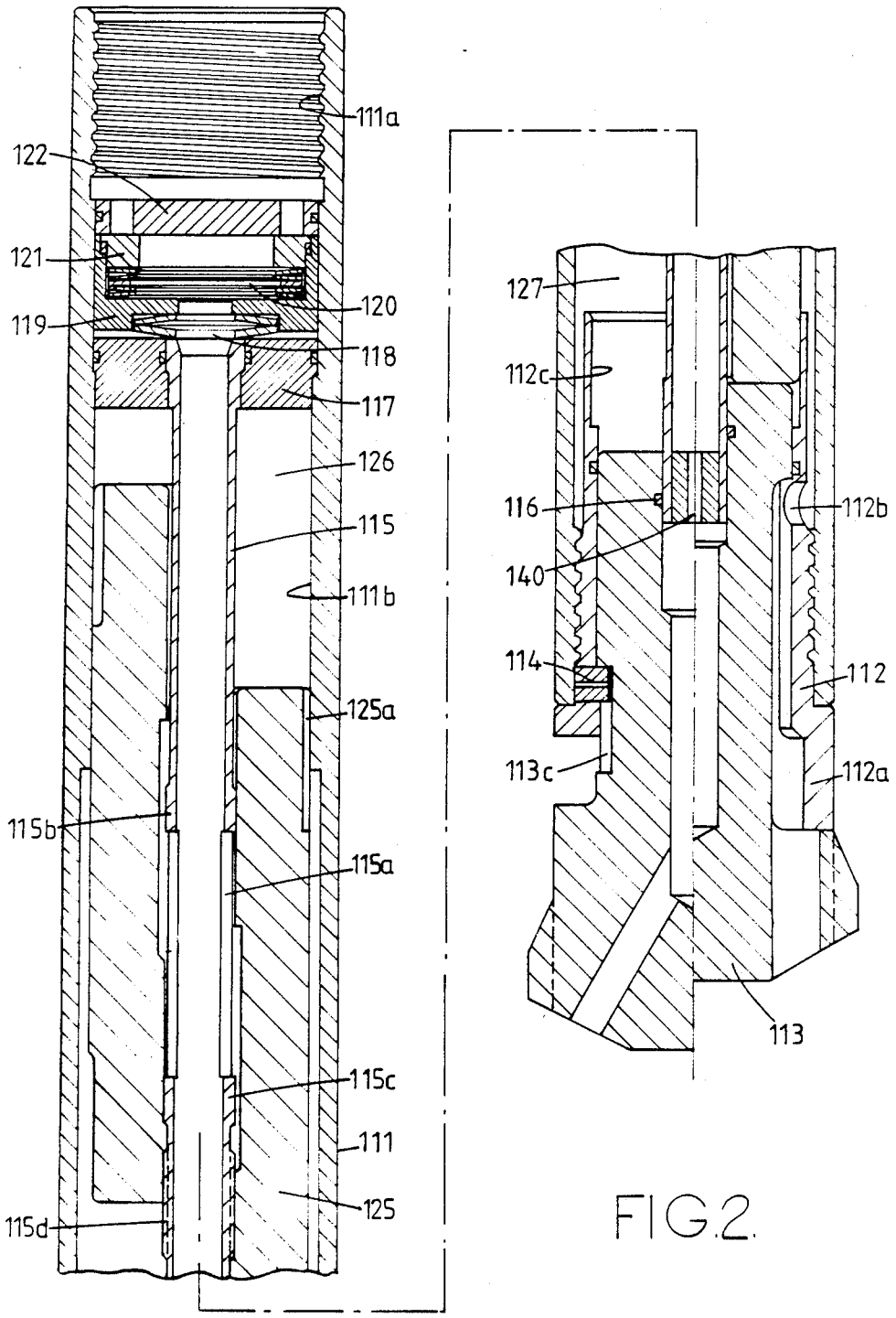

FIG. 1 is a longitudinal sectional view showing one example of the invention; and FIG. 2 is a similar view showing another example.

Referring firstly to FIG. 1, the hammer drill shown is of the sampling type, that is to say it incorporates a sample tube 10 through which chippings etc. cut by the drill are returned to the surface in use entrained with at least a portion of the pressurised fluid (for example compressed air) which is supplied to the drill via the outer annular section passageway of a coaxial dual tube drill string.

The drill includes a body tube 11 which is adapted at its upper end to be fitted to the end of the outer tube of the drill string. To this end, the body tube 11 has a screw thread 11*a*.

Mounted on the lower end of the body tube is a chuck 12 which retains a cutter bit 13. Chuck 12 and cutter bit 13 comprise a cutter assembly. The chuck 12 is screw-threadedly engaged with the body tube and has at its lower end three axially projecting dogs 12*a* which fit into corresponding recesses in the exterior of the cutter bit 13 so as to provide a driving connection between the body tube and the cutter bit 13. The cutter bit 13 is retained in the chuck by means of three plugs 14 which are fitted in bores in the wall of the chuck and project into three longitudinally extending grooves 13*a* in the exterior of the shank of the cutter bit. These plugs permit axial movement of the cutter bit between the two positions shown in the right and left hand halves of FIG. 1. The plugs 14 are retained by containment within the lower end of the body tube.

Surrounding the sample tube 10 is an inner tube 15 which extends from substantially the upper end of the body tube coaxially therewith into sliding engagement with an axial bore in the shank of the cutter bit 13. As will be seen from FIG. 1 the inner tube is sufficiently long to remain in engagement with this bore even when the cutter bit is in its lowered position as shown in the left hand half of FIG. 1. An "O" ring seal 16 is shown fitted in the bore in the cutter bit shank, but this may not always be necessary.

The upper end of the inner tube 15 is externally of stepped configuration which fits in a stepped bore in a mounting disc 17 mounted at the upper end of the body tube. A pair of spring washers 18 are compressed between the end of the inner tube 15 and a non return valve body 19 fitted in the body tube. Wavy spring washers 20 are compressed between this valve body and an annular non-return valve closure element 21 which seat on an annular valve seat 22. This seat is fastened to the sample tube and the whole assembly is held together by the coupling thereto of the dual tube drill string (not shown). The non-return valve ensures that reverse flow up the drill string cannot occur at times when the compressed air supply is turned off. This prevents ground water carrying mud particles entering the working parts of the hammer mechanism and causing damage thereto.

In the annular section space between the inner tube and the body tube an annular section hammer piston 25 is reciprocably mounted. This piston is slidable on the inner tube 15 and also slidably engages the interior of the body tube. The piston divides the annular section space referred to into upper and lower chambers 26 and 27. The piston itself controls airflow to and from these chambers.

In the left hand half of FIG. 1 which shows the piston in a raised position the annular passage 28 between the inner tube 15 and the sample tube 10 communicates with the upper chamber 26 via ports 15*a* in the inner tube. In this position a land 15*b* on the inner tube 15 above the ports 15*a* lies within an inner region of the piston 25 which is of greater internal diameter than upper and lower end regions of the piston 25, so that there is an annular clearance between the inner tube 15 and the piston 25 providing the connection between the ports 15*a* and the upper chamber 26. The piston itself is a close fit in this position in an upper reduced internal diameter zone 11*b* of the body tube 11, so that there is no communication between the upper and lower chambers externally of the piston. A land 15*c* on the inner tube 15 below the ports 15*a* engages the lower end region of the piston 25 to isolate the upper and lower chambers from one another internally of the piston. In normal use, the cutter bit 13 is in the raised position shown on the right hand side of FIG. 1 and, in this position and with the piston raised, the lower chamber is opened to exhaust via exhaust ports 12*b* in the chuck wall.

In the lowered position of the piston 25 shown in the right hand half of FIG. 1, it is the lower land 15*c* on the tube 15 which lies within the inner region of the piston and the upper land 15*b* engages the upper end region of the piston. The lower end of the piston engages in a valve sleeve portion 12*c* which extends upwardly from the upper end of the chuck 12. A fluted portion 15*d* on the inner tube below the lower land 15*c* engages in the lower end region of the piston to provide an adequate central location for the tube 15 in this position. There is thus provided a high pressure fluid flow connection between the ports 15*a* and the interior of the valve sleeve portion 12*c*. A connection between the upper chamber 26 and the exhaust ports 12*b* is provided via flutes or flats 25*a* formed on the exterior of the piston at its upper end.

Starting from the position shown in the right hand half of FIG. 1, a cycle of operation of the hammer is as follows:

(a) The high pressure acting on the lower end of the piston accelerates the piston upwardly.

(b) The first change in the connections described above occurs when the land 15*c* engages the lower end region of the piston. This blocks the connection between the high pressure ports 15*a* and the lower chamber, but high pressure fluid trapped in this chamber continues to urge the piston upwardly and it therefore continues to accelerate upwardly.

(c) This situation continues until the communication between the upper chamber 26 and the ports 12*b* is blocked when the unfluted part of the piston enters the reduced part 11*b* of the body. By now, the piston has achieved a considerable upward velocity and this closing off of the upper chamber causes the fluid trapped therein to be compressed thereby initiating slowing of the piston.

(d) Very shortly after step (c) the lower end of the piston 25 leaves the valve sleeve portion 12*c* and the land 15*b* enters the inner region of piston 25. The lower end of the piston is now at exhaust pressure and high pressure is applied to the upper end causing rapid slowing of the piston until it comes to rest in the position shown in the left hand half of FIG. 1. The piston then starts to accelerate downwardly.

(e) The reverse sequence now occurs, with the piston motion being cushioned when the piston reaches the sleeve portion 12*c*. The piston eventually strikes the upper end of the cutter bit shank and then the whole cycle recommences.

For flushing away of chippings cut by the cutter bit as a result of repeated percussive blows being delivered thereto whilst it is being rotated (by rotation of the drill string by a surface level rig) a small proportion of the air supplied to the drill is allowed to pass beyond the ports 15*a* into an annular passage 30 formed between the lower end of the sample tube 10 and the interior of the cutter bit stem. Fitted into the interior of the cutter bit stem is an air flow reversing device 31 which includes a tubular portion 31*a* extending upwardly into the interior of the sample tube which is internally enlarged to receive this tubular portion. The sample tube 10 and the tubular portion 31*a* together define an annular nozzle the axial length of which is very much larger than the width of the annular gap (i.e. the difference between the internal and external radii of the annular nozzle). This ensures a strong upward flow of high pressure air into the sample tube which can entrain the chippings or other material and carry it away up the sample tube.

It is to be noted that the annular nozzle construction described in the immediately preceding paragraph may be regarded as a feature of the hammer drill which is independent of the specific hammer construction, that is the nozzle construction could be used with other types of hammer drill.

Turning now to FIG. 2 it will immediately be appreciated by the reader skilled in this art that no sample tube is included. In principle, however, the design of the hammer mechanism is the same as that shown in FIG. 1, except that the inner tube is of smaller diameter.

Parts shown in FIG. 2 which correspond to parts included in FIG. 1, have the same reference numerals increased by 100 and will not be redescribed.

It will be noted that the lower end of the inner tube 115 terminates in a flow restrictor plug 140 through which additional flushing air can flow into a passage in the bit 113. This passage opens on to the lower face of the bit 113 and provides a supply of air in addition to the hammer exhaust to cool the bit face and blow away chippings etc. The plug 140 may have a variable orifice or it may be selected from a range of different plugs to suit the cutting bit in use and the working conditions.

I claim:

1. A valveless down-the-hole hammer drill for use with a drill string, comprising;

a body tube for attachment at one end to the drill string;

a chuck carried by said body tube adjacent its opposite end and having an exhaust port and a valve sleeve;

a cutter bit carried by said chuck and having an upwardly directed bore;

means cooperable between said cutter bit and said chuck mounting said cutter bit for axial movement relative to said chuck;

an inner tube extending coaxially within said body tube for supplying fluid under pressure and received at one end in said bore for sliding movement of said cutter bit relative thereto;

an annular piston disposed between said inner tube and said body tube and movable axially relative thereto and for engagement at one end in said valve sleeve, said piston defining with said inner tube and said body tube chambers at opposite ends of said piston and carrying a pair each of inner and outer valve surfaces;

means defining a fluid supply port in said inner tube for communicating the pressure fluid from said inner tube;

means defining valve surfaces on said inner tube and cooperable with the pair of inner valve surfaces on said piston, respectively, for supplying the pressure fluid in said inner tube communicating through said fluid supply port alternately to said chambers; and means including a valve surface on said body tube and cooperable with a first of said pair of outer valve surfaces carried by said piston for exhausting the fluid from one of said chambers through said exhaust port;

the second of said pair of said outer valve surfaces carried by said piston being cooperable with said valve sleeve for exhausting the fluid from the other of said chambers through said exhaust port;

whereby said piston is reciprocable in said body in an axial direction in response to the supply and exhaust of pressure fluid relative to said chambers to repeatedly deliver percussive blows to said cutter bit.

2. A hammer drill according to claim 1 wherein said cutter bit includes means defining a central passageway, a sample tube within said inner tube and defining with said inner tube an annular space therebetween, means defining with said sample tube an annular nozzle disposed within said central passageway and arranged to direct air flowing through said annular space between said inner tube and said sample tube upwardly into the lower end of said sample tube.

3. A hammer drill according to claim 2 wherein said nozzle is formed by an air flow reversing device carried by said cutting bit and including a tubular portion extending into the lower end of said sample tube.

4. A hammer drill according to claim 3 in which said tubular portion extends into the lower end of said sample tube a distance greater than the width of the annular space formed between the tubular portion and the sample tube.

5. A hammer drill according to claim 1 wherein the inner surface of said piston is cylindrical and stepped at axially spaced locations therealong to form an inner surface intermediate the pair of inner valve surfaces carried by said piston, said intermediate inner piston surface having a diameter greater than the diameters of said pair of inner valve surfaces carried by said piston, said valve surfaces on said inner tube comprising a pair of axially spaced annular lands straddling said fluid supply port, said lands being cooperable with the pair of inner valve surfaces for supplying the pressure fluid to said chambers via said inner intermediate piston surface.

6. A hammer drill according to claim 5 wherein said inner tube has an external fluid portion located between said chuck and the land closest to said chuck and in engagement with an inner surface portion of said piston to provide guidance therefor.

7. A hammer drill according to claim 5 wherein said piston has an external fluted portion located between said first valve surface carried by said piston and a corresponding end of said piston, said fluted portion slidably engaging said body tube to provide guidance for said piston.

8. A hammer drill according to claim 1 wherein each of said inner valve surfaces on said inner tube and said pair of inner valve surfaces on said piston move relatively between valve-opened and valve-closed position, in response to axial movement of said piston and define immediate annular openings, respectively, for flow of pressure fluid in response to axial movement of said piston between said valve-closed position and said valve-opened position.

9. A hammer drill according to claim 1 wherein said fluid supply port in said inner tube is located at a single predetermined axial position along said inner tube and communicates pressure fluid alternately to both said chambers.

10. A hammer drill according to claim 5 wherein said fluid supply port in said inner tube is located at a single predetermined axial position along said inner tube and communicates pressure fluid alternately to both said chambers via said inner intermediate piston surface.

11. A hammer drill according to claim 9 wherein said supply port comprises a plurality of slots in said inner tube spaced circumferentially one from the other about said inner tube, with each slot extending in an axial direction a distance greater than its width.

12. A hammer drill according to claim 1 wherein said annular piston has generally cylindrical inner and outer surfaces, said piston being void of pressure fluid supply bores wholly within said piston between said surfaces and extending in the axial direction.

13. A hammer drill according to claim 1 wherein said valve surface on said body tube is cooperable with said first outer valve surface carried by said piston to prevent communication between said one chamber and said exhaust port in response to axial movement of said piston in said body tube toward said one chamber before said piston reaches the end of its stroke in said one chamber to compress the pressure fluid therein.

14. A hammer drill according to claim 1 wherein said second outer valve surface carried by said piston and said valve sleeve prevent communication between the other chamber and said exhaust port in response to axial movement of said piston in said body tube toward said other chamber before said piston reaches the end of its stroke in said other chamber to compress the pressure fluid therein.

15. A hammer drill according to claim 14 wherein one of said valve surfaces on said inner tube and one of the inner valve surfaces on said piston are relatively movable between a valve-closed position preventing communication of pressure fluid between said supply port and said other chamber and a valve-opened position supplying pressure fluid from said supply port to said other chamber, said one valve surface on said inner tube and said one inner valve surface on said piston being located to move from said valve-closed position to said valve-opened position subsequent to said second outer valve surface carried by said piston and said valve sleeve prevent communication between said lower chamber and said exhaust port.

* * * * *